US009953551B2

(12) United States Patent
Best

(10) Patent No.: US 9,953,551 B2
(45) Date of Patent: Apr. 24, 2018

(54) DOOR HANDLE DISPLAY MEMBER

(71) Applicant: Display Technologies, LLC, Lake Success, NY (US)

(72) Inventor: Douglas E. Best, Peekskill, NY (US)

(73) Assignee: Display Technologies LLC, Lake Success, NY (US)

( * ) Notice: Subject to any disclaimer, the term of this patent is extended or adjusted under 35 U.S.C. 154(b) by 0 days.

(21) Appl. No.: 15/484,592

(22) Filed: Apr. 11, 2017

(65) Prior Publication Data

US 2017/0294153 A1 Oct. 12, 2017

Related U.S. Application Data

(60) Provisional application No. 62/320,758, filed on Apr. 11, 2016.

(51) Int. Cl.
*G09F 23/00* (2006.01)
*G09F 7/18* (2006.01)

(52) U.S. Cl.
CPC ..... *G09F 23/0058* (2013.01); *G09F 7/18* (2013.01); *G09F 2007/1847* (2013.01); *G09F 2007/1856* (2013.01)

(58) Field of Classification Search
CPC .... G09F 7/18; G09F 23/00; G09F 2007/1856; E05B 1/0015; E05B 1/0084
See application file for complete search history.

(56) References Cited

U.S. PATENT DOCUMENTS

| | | | | |
|---|---|---|---|---|
| 5,355,554 | A * | 10/1994 | Magoon | E05L 31/0015 16/412 |
| 6,119,385 | A * | 9/2000 | Olivier | G09F 23/00 40/599 |
| 6,948,272 | B1 * | 9/2005 | Olivier | G09F 7/18 40/331 |
| 9,032,653 | B2 | 5/2015 | English | |
| 9,082,324 | B1 * | 7/2015 | Brown | G09F 7/18 |
| 9,189,983 | B2 | 11/2015 | English | |
| 9,196,177 | B2 | 11/2015 | English | |
| 9,574,371 | B2 | 2/2017 | English | |
| 9,626,886 | B2 * | 4/2017 | Francavilla | G09F 23/00 |
| 2006/0012189 | A1 * | 1/2006 | Olivier | E05L 31/0015 292/336.3 |
| 2013/0000632 | A1 * | 1/2013 | Lundahl | G09F 23/00 126/574 |
| 2014/0001130 | A1 * | 1/2014 | English | G09F 7/18 211/49.1 |
| 2014/0001982 | A1 * | 1/2014 | English | G09F 7/18 315/362 |

(Continued)

*Primary Examiner* — Shin H Kim
(74) *Attorney, Agent, or Firm* — Carter, DeLuca, Farrell & Schmidt, LLP

(57) ABSTRACT

A door handle display member including a first bracket assembly and a graphics panel. The first bracket assembly is configured to releasably engage a door handle and includes a first member, a second member, and a third member. The first member has a first leg and a second leg. The second member is configured to releasably engage the first leg and the second leg of the first member. The third member is configured to threadably engage the first leg and the second leg of the first member, and is configured to releasably engage the second member. The graphics panel is configured to releasably engage the first bracket assembly.

15 Claims, 5 Drawing Sheets

(56) References Cited

U.S. PATENT DOCUMENTS

| | | | | |
|---|---|---|---|---|
| 2014/0053440 | A1* | 2/2014 | English | G09F 23/00 40/599 |
| 2014/0137449 | A1 | 5/2014 | English | |
| 2016/0210889 | A1* | 7/2016 | Francavilla | G09F 23/00 |
| 2016/0305154 | A1 | 10/2016 | English | |
| 2017/0046990 | A1* | 2/2017 | Cummings | G09F 23/00 |
| 2017/0294153 | A1* | 10/2017 | Best | G09F 23/0058 |

* cited by examiner

DOOR HANDLE DISPLAY MEMBER

CROSS-REFERENCE TO RELATED APPLICATION

The present application claims the benefit of and priority to U.S. Provisional Patent Application Ser. No. 62/320,758 filed on Apr. 11, 2016, the entire contents of which being hereby incorporated by reference in its entirety.

BACKGROUND

The present disclosure relates to display members that are configured to be engaged with a door handle. More particularly, the present disclosure relates to door handle display members that are engageable with a handle of a door (e.g., a refrigerator door) in a retail environment, for example, and which are configured to display product information.

SUMMARY

The present disclosure relates to a door handle display member including a first bracket assembly and a graphics panel. The first bracket assembly is configured to releasably engage a door handle and includes a first member, a second member, and a third member. The first member has a first leg and a second leg. The second member is configured to releasably engage the first leg and the second leg of the first member. The third member is configured to threadedly engage the first leg and the second leg of the first member, and is configured to releasably engage the second member. The graphics panel is configured to releasably engage the first bracket assembly.

In disclosed embodiments, the first member is U-shaped.

It is further disclosed that the graphics panel includes at least one ring-like extension configured to engage an outer wall of the third member. It is also disclosed that the graphics panel includes at least one finger configured to engage the second member of the first bracket assembly. In embodiments, the graphics panel includes at least one finger configured to engage a slot of the second member of the first bracket assembly. In disclosed aspects, one finger of the at least one finger of the graphics panel is disposed within one ring-like extension of the at least one ring-like extension.

In disclosed embodiments, the door handle display member includes a second bracket assembly, which is identical or substantially identical to the first bracket assembly. In embodiments, the graphics panel is configured to releasably engage the second bracket assembly as well as the first bracket assembly. It is also disclosed that the graphics panel includes two ring-like extensions, where each ring-like extension is configured to engage an outer wall of the third member of each of the first bracket assembly and the second bracket assembly.

The present disclosure also relates to a method of displaying product information. The method includes positioning a first member of a first bracket assembly adjacent a door handle such that a body portion of the first member is distal of the door handle and such that a first leg and a second leg of the first member straddle the door handle, engaging a second member of the first bracket assembly with the first leg and the second leg of the first member, threadably engaging a third member of the first bracket assembly with the first leg and the second leg of the first member, and engaging a graphics panel with the first bracket assembly.

In embodiments of the method, engaging the graphics panel with the first bracket assembly includes engaging a first ring-like extension of the graphics panel with an outer wall of the third member of the first bracket assembly.

Embodiments of the method also include engaging a second ring-like extension of the graphics panel with a second bracket assembly.

In disclosed embodiments, engaging the graphics panel with the first bracket assembly includes engaging a first finger of the graphics panel with a slot of the second member of the first bracket assembly. Embodiments of the method also include engaging a second finger of the graphics panel with a portion of a second bracket assembly.

BRIEF DESCRIPTION OF DRAWINGS

Embodiments of the present disclosure are described hereinbelow with reference to the drawings wherein.

DETAILED DESCRIPTION

Embodiments of the presently disclosed door handle display member are described in detail with reference to the drawings wherein like numerals designate identical or corresponding elements in each of the several views. In the descriptions that follow, the term "proximal," as is traditional, will refer to the portions of the door handle display members that are closer to the user (e.g., consumer), while the term "distal" will refer to the portions that are farther from the user.

Figure 3:
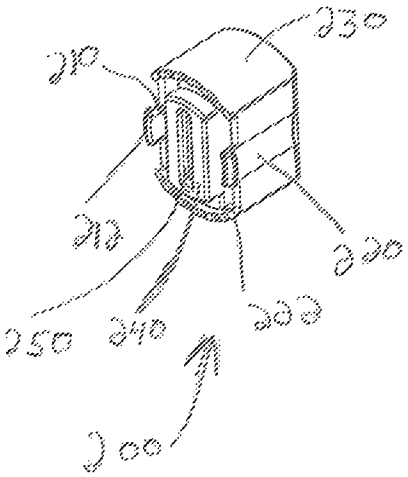
FIG. 3 includes various views of a second member of the bracket assembly of FIG. 1.
Figure 3:
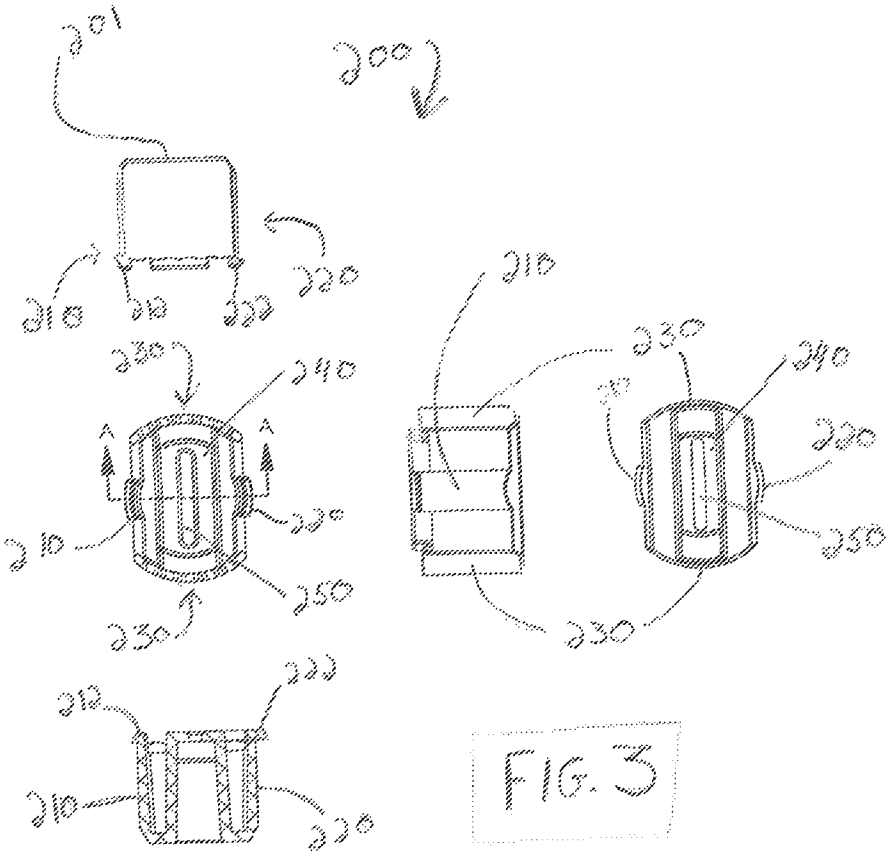
Figure 4:
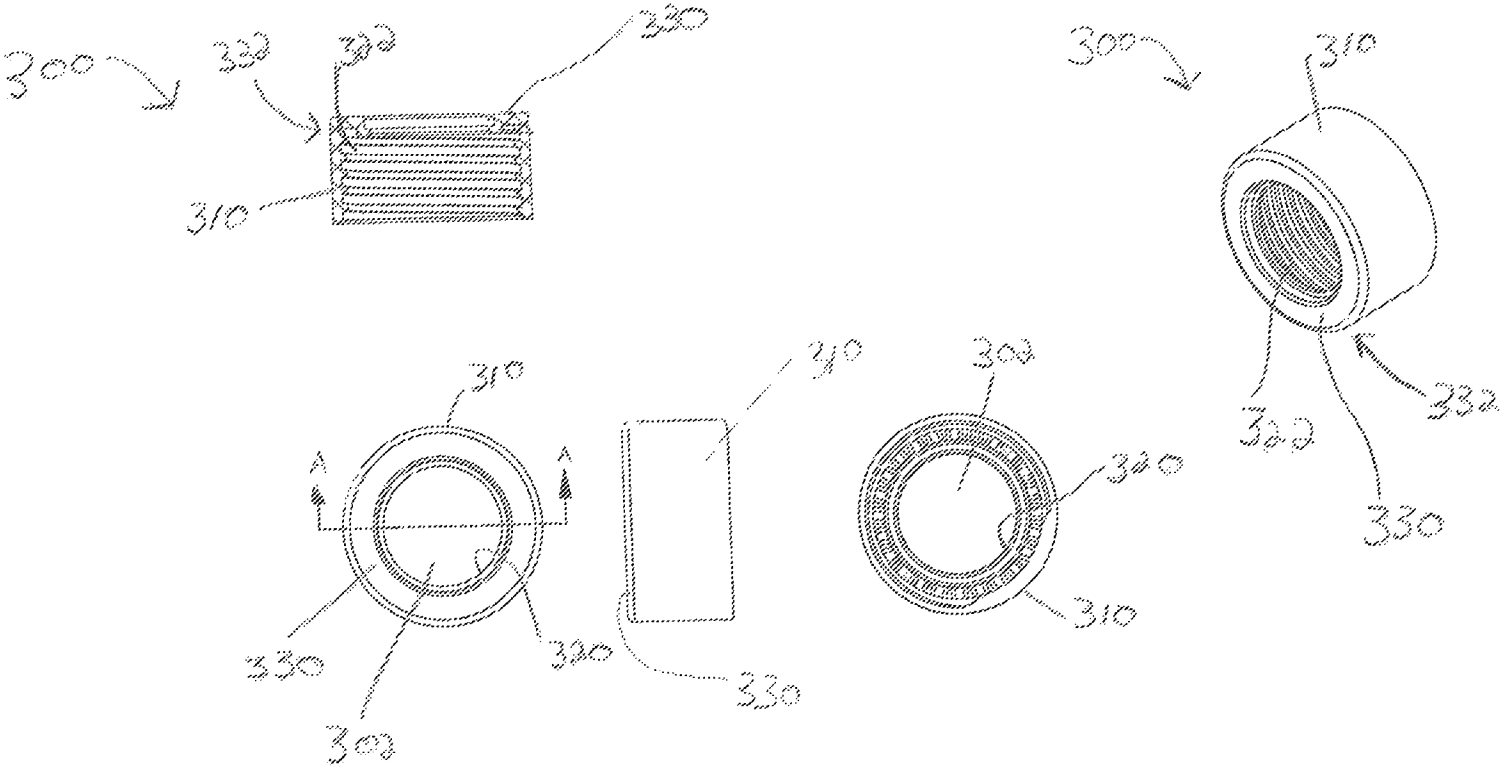
FIG. 4 includes various views of a third member of the bracket assembly of FIG. 1.
Figure 5:
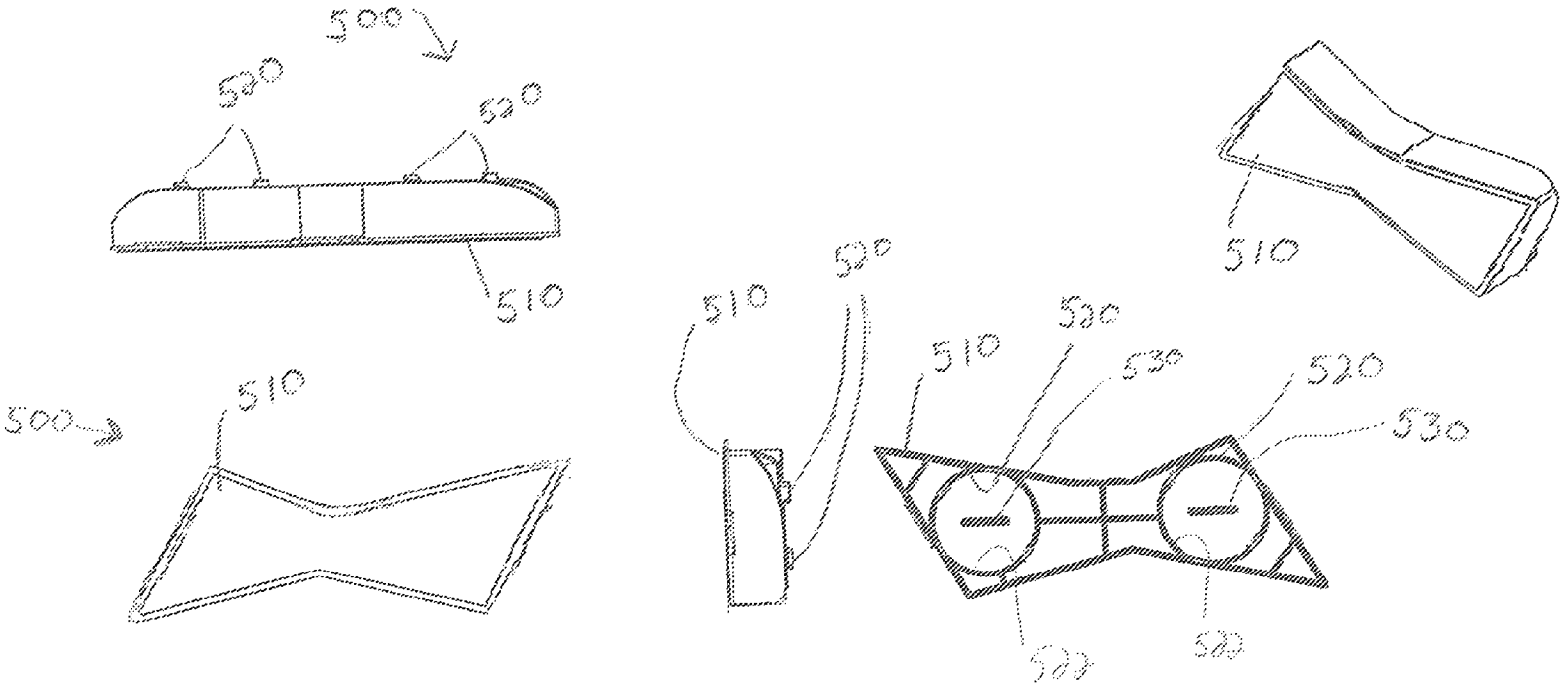
FIG. 5 includes various views of a graphics panel of the door handle display member.

With reference to the accompanying figures, the features of a door handle display member are illustrated in FIGS. 1-5. In particular, FIGS. 1-4 illustrate a bracket assembly 100 of the door handle display member, and FIG. 5 illustrates a graphics panel 500 of the door handle display member. Further, each door handle display member includes two bracket assemblies 100 and one graphics panel 500. Generally, and as discussed in further detail below, each bracket assembly 100 engages a door handle, and graphics panel 500 simultaneously engages both bracket assemblies 100.

Figure 1:
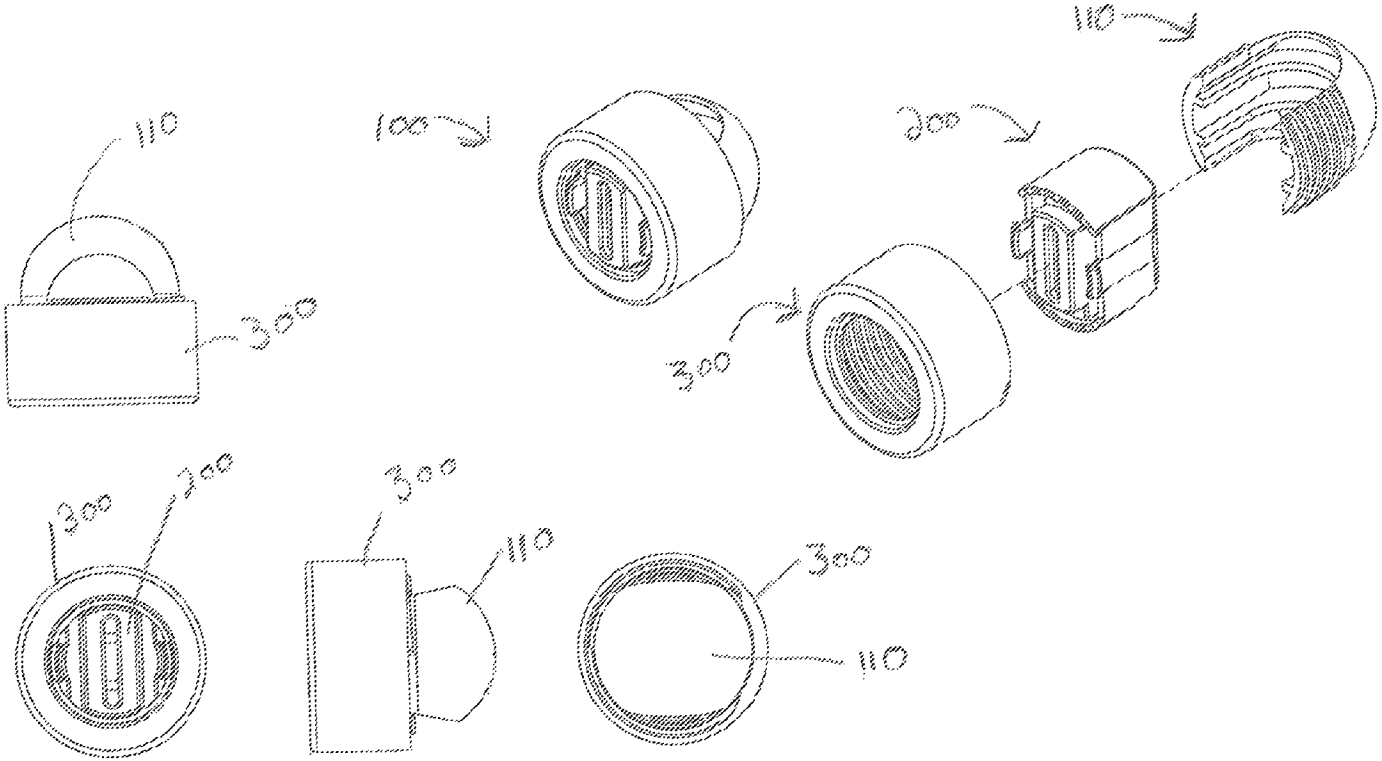
FIG. 1 includes various views of a bracket assembly of the door handle display member in accordance with an embodiment of the present disclosure.

With particular reference to FIG. 1, bracket assembly 100 includes a first member 110, a second member 200, and a third member 300. A portion of first member 110 is configured for positioning distally of the door handle. Second member 200 is configured to engage first member 110. Third member 300 is configured to engage first member 110 and second member 200. Graphics panel 500 (FIG. 5) is configured to engage two third members 300 and/or two second members 200. Accordingly, two bracket assemblies 100 are configured to support graphics panel 500 on the door handle. As can be appreciated, graphics panel 500 can display any type of information (e.g., a product name, a product logo, price, etc.) and may be any reasonable shape and size.

Figure 2:
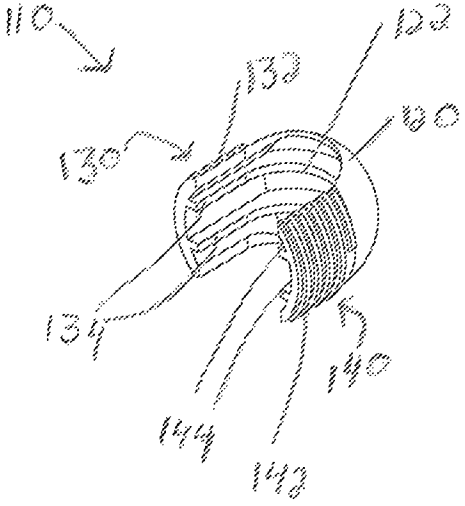
FIG. 2 includes various views of a first member of the bracket assembly of FIG. 1.
Figure 2:
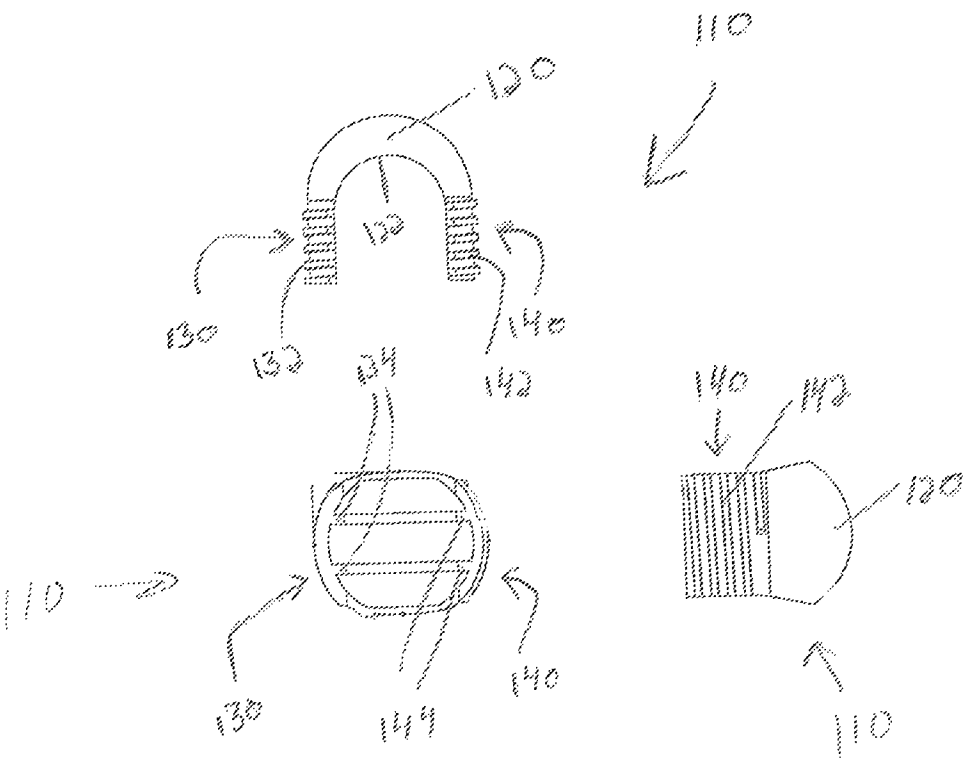

Referring now to FIG. 2, various views of first member 110 are shown. First member 110 includes a body portion 120, a first leg 130 extending from body portion 120, and a second leg 140 extending from body portion 120. An outer portion of first leg 130 includes a threaded portion 132, and an outer portion of second leg 140 includes a threaded portion 142. Threaded portions 132, 142 are configured to engage third member 300 (FIG. 4) of bracket assembly 100. An inner portion of first leg 130 includes a pair of ribs 134, and an inner portion of second leg 140 includes a pair of ribs 144. Ribs 134, 144 are configured to engage third member 300 of bracket assembly 100 and/or help align first member 110 and third member 300 of bracket assembly 100.

A proximal part 122 of body portion 120 is configured to contact a distal surface of a door handle. In the illustrated embodiment, proximal part 122 of body portion 120 is curved or arcuate, but other shapes such as linear are also contemplated by the present disclosure (e.g., if the distal surface of the door handle includes a flat or linear portion). Moreover, proximal part 122 of body portion 120 may be dimensioned to mirror the shape of the distal portion of a particular door handle. Further, while first member 110 is U-shaped in the illustrated embodiment, first member 110 is not limited to the particular shape shown.

Referring now to FIG. 3, various views of second member 200 are shown. Second member 200 includes a first lateral arm 210, a second lateral arm 220, arcuate portions 230, a body portion 240, and a slot 250. First lateral arm 210 is configured to fit between and slidably engage the pair of ribs 134 of first leg 130 of first member 110, and second lateral arm 220 is configured to fit between and slidably engage the pair of ribs 144 of second leg 140 of first member 110. Accordingly, second member 200 is configured to releasably engage first member 110.

Additionally, a proximal end of first lateral arm 210 includes a first flange 212 extending radially outward therefrom, and a proximal end of second lateral arm 220 includes a second flange 222 extending radially outward therefrom. First and second flanges 212, 222 may be biased radially outward, and are configured to releasably engage third member 300 (FIG. 4) while arcuate portions 230 are configured to engage portions of third member 300 (FIG. 4), as discussed below. Slot 250 is disposed within body portion 240, and is configured to accept a portion of graphics panel 500 (FIG. 5), as discussed below.

With reference to FIG. 4, various views of third member 300 are shown. Third member 300 is generally ring-shaped and defines an aperture 302 therein. Second member 200 (FIG. 3) is configured to fit at least partially within aperture 302 of third member 300. Third member 300 includes an outer wall 310 and an inner wall 320. Inner wall 320 includes a threaded portion 322, which is configured to engage threaded portions 132, 142 of first and second legs 130, 140, respectively, of first member 110 (FIG. 2). Third member 300 also includes a lip 330 adjacent a proximal portion 332 thereof. Lip 330 is configured to mechanically engage first flange 212 and second flange 222 of second member 200 (FIG. 3) of bracket assembly 100.

With reference to FIG. 5, various views of graphics panel 500 are shown. Graphics panel 500 includes a graphics display portion 510, two ring-like extensions 520 projecting distally from graphics display portion 510, and two fingers 530 projecting distally from graphics display portion 510. Each finger 530 is disposed within one of the extensions 520. Each extension 520 is configured to mechanically engage outer wall 310 of third portion 300 (FIG. 4) of one bracket assembly 100. In particular, an inner surface 522 of extension 520 engages outer wall 310 of third portion 300 (FIG. 4). It is envisioned that extensions 520 are sufficiently radially flexible to enable releasable engagement with outer wall 310 of third portion 300. It is also envisioned that an inner diameter of each extension 520 is slightly larger than an outer diameter of third portion 300 (i.e., outer wall 310) to enable a friction fit therebetween, which would also enable releasable engagement between extensions 520 of graphics panel 500 and third portion 300. Each finger 530 is configured to slidably engage slot 250 of second member 200 (FIG. 3).

As can be appreciated, graphics panel 500, which made be made from plastic or another suitable material, can be tailored to any specific or desirable need. For example, graphics panel 500 can display advertising information, product information, price information, etc. The graphics panel 500 on a refrigerator door handle, for example, provides an additional area of advertisement for a retailer, which may lead to greater product sales.

To install the door handle display member on a door handle, a first bracket assembly is installed on a door handle. In particular, first member 110 of bracket assembly 100 is positioned such that body portion 120 is distal of the door handle, while first leg 130 and second leg 140 extend proximally from body portion 120 and straddle the door handle. Next, second member 200 of bracket assembly 100 is positioned in engagement with first member 100. In particular, first lateral arm 210 and second lateral arm 220 are respectively positioned in engagement with or at least partially between ribs 134, 144 of first and second legs 130, 140, respectively. Additionally, a distal face 201 of second member 200 is positioned in contact with or in close contact with a proximal surface of the door handle. Next, third member 300 of bracket assembly 100 is engaged with first member 110 of bracket assembly 100. In particular, threaded portion 322 of inner wall 320 of third member 300 engages threaded portion 132 of first leg 130 and threaded portion 142 of second leg of first member 110. Next, third member 300 is rotated (e.g., clockwise) with respect to first member 110 to cause third member 300 to move distally with respect to first member 110. Continued rotation of third member 300 causes lip 330 thereof to move distally beyond flanges 212, 222 of second member 200, such that flanges 212, 222 spring radially outward and engage lip 330 to help minimize further movement between first member 110, second member 200 and third member 300 and bracket assembly 100.

Next, a second bracket assembly 100 is installed on the door handle in a manner similar to or the same as the first bracket assembly 100. The second bracket assembly 100 is positioned in a spaced relationship from the first bracket assembly 100, such that each of the first and second bracket assemblies 100 is in alignment or substantial alignment with one ring-like extension 520 of graphics panel 500.

Finally, graphics panel 500 is engaged with third member 300 of each of the first and second bracket assemblies 100. In particular, inner surface 522 of each ring-like extension 520 of graphics panel 500 engages outer wall 310 of one third member 300, and, optionally, each finger 530 of graphics panel 500 engages slot 250 of one second member 200.

Alternatively, third member 300 may engage second member 200 prior to second member 200 engaging first member 110. Here, the combination of second member 200 and third member 300 can together engage first member 110, and the vertical position of bracket assembly 100 can be altered to precisely align with ring-like extension(s) 520 of graphics panel 500 before fully engaging (e.g., rotating as much as possible) third member 300 and first member 110 of bracket assembly 100.

To remove door handle display member from the door handle, a user pulls graphics panel 500 proximally with respect to bracket assembly 100 to remove graphics panel 500 from engagement with bracket assembly 100. Next, flanges 212, 222 of each second member 200 are pushed radially inward while third members 300 are rotated (e.g., counter-clockwise) with respect to first members 110 to cause third members 300 to move proximally and out of engagement from respective first members 110 and second members 200. Next, second members 200 are pulled proximally out of engagement from respective first members 110. Alternatively, after graphics panel 500 is removed, and before third members 300 are disengaged from second members 200, third members 300 may be rotated (e.g., counter-clockwise) with respect to respective first members 110 to cause the combination of third members 300 and second members 200 to disengage from respective first members 110 of each of the two bracket assemblies 100.

The present disclosure also includes methods of displaying product information using the door handle display member, including utilizing the steps above. For example, disclosed methods include positioning first member 110 of a first bracket assembly 100 adjacent a door handle such that body portion 120 of the first member 110 is distal of the door handle and such that first leg 130 and second leg 140 of the first member 110 straddle the door handle, engaging second member 200 of the first bracket assembly 100 with the first leg 130 and the second leg 140 of the first member 110, threadably engaging third member 300 of the first bracket assembly 100 with the first leg 130 and the second leg 140 of the first member 110, and engaging graphics panel 500 with the first bracket assembly 100.

While embodiments of the disclosure have been shown in the figures, it is not intended that the disclosure be limited thereto, as it is intended that the disclosure be as broad in scope as the art will allow and that the specification be read likewise. Therefore, the above description should not be construed as limiting, but merely as exemplifications of various embodiments. Those skilled in the art will envision other modifications within the scope and spirit of the claims appended hereto.

The invention claimed is:

1. A door handle display member, comprising:
   - a first bracket assembly configured to releasably engage a door handle, the first bracket assembly including:
     - a first member having a first leg and a second leg;
     - a second member configured to releasably engage the first leg and the second leg of the first member; and
     - a third member configured to threadedly engage the first leg and the second leg of the first member, the third member configured to releasably engage the second member; and
   - a graphics panel configured to releasably engage the first bracket assembly.

2. The door handle display member according to claim 1, wherein the first member of the first bracket assembly is U-shaped.

3. The door handle display member according to claim 1, wherein the graphics panel includes at least one ring-like extension configured to engage an outer wall of the third member of the first bracket assembly.

4. The door handle display member according to claim 3, wherein the graphics panel includes at least one finger configured to engage the second member of the first bracket assembly.

5. The door handle display member according to claim 3, wherein the graphics panel includes at least one finger configured to engage a slot of the second member of the first bracket assembly.

6. The door handle display member according to claim 4, wherein one finger of the at least one finger of the graphics panel is disposed within one ring-like extension of the at least one ring-like extension.

7. The door handle display member according to claim 1, further comprising a second bracket assembly, the second bracket assembly being identical to the first bracket assembly.

8. The door handle display member according to claim 7, wherein the graphics panel is configured to releasably engage the second bracket assembly.

9. The door handle display member according to claim 8, wherein the graphics panel includes two ring-like extensions, each ring-like extension configured to engage an outer wall of the third member of each of the first bracket assembly and the second bracket assembly.

10. A method of displaying product information comprising:
   - positioning a first member of a first bracket assembly adjacent a door handle such that a body portion of the first member is distal of the door handle and such that a first leg and a second leg of the first member straddle the door handle;
   - engaging a second member of the first bracket assembly with the first leg and the second leg of the first member;
   - threadably engaging a third member of the first bracket assembly with the first leg and the second leg of the first member; and
   - engaging a graphics panel with the first bracket assembly.

11. The method according to claim 10, wherein engaging the graphics panel with the first bracket assembly includes engaging a first ring-like extension of the graphics panel with an outer wall of the third member of the first bracket assembly.

12. The method according to claim 11, further comprising engaging a second ring-like extension of the graphics panel with a second bracket assembly.

13. The method according to claim 10, wherein engaging the graphics panel with the first bracket assembly includes engaging a first finger of the graphics panel with a slot of the second member of the first bracket assembly.

14. The method according to claim 11, wherein engaging the graphics panel with the first bracket assembly also includes engaging a first finger of the graphics panel with a slot of the second member of the first bracket assembly.

15. The method according to claim 14, further comprising engaging a second finger of the graphics panel with a portion of a second bracket assembly.

* * * * *